US008763214B2

(12) United States Patent
Yang

(10) Patent No.: US 8,763,214 B2
(45) Date of Patent: Jul. 1, 2014

(54) FASTENING DEVICE

(75) Inventor: Kuo-Lung Yang, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 468 days.

(21) Appl. No.: 13/095,900

(22) Filed: Apr. 28, 2011

(65) Prior Publication Data

US 2012/0167357 A1 Jul. 5, 2012

(30) Foreign Application Priority Data

Dec. 29, 2010 (TW) ..... 99146596

(51) Int. Cl.
*B25B 23/10* (2006.01)
*B25B 5/04* (2006.01)

(52) U.S. Cl.
USPC ..... 24/500

(58) Field of Classification Search
USPC ..... 24/500; 411/433, 437, 540, 254, 255
See application file for complete search history.

(56) References Cited

U.S. PATENT DOCUMENTS

| | | | | | |
|---|---|---|---|---|---|
| 971,375 | A * | 9/1910 | Hays | 29/217 |
| 2,118,361 | A * | 5/1938 | Schaeffer, Jr. | 411/433 |
| 3,815,434 | A * | 6/1974 | Seger | 74/424.79 |
| 5,152,651 | A * | 10/1992 | Arteon | 411/433 |
| 5,927,920 | A * | 7/1999 | Swanstrom | 411/180 |
| 6,553,617 | B1 * | 4/2003 | Salice | 16/85 |
| 7,479,593 | B1 * | 1/2009 | Townsend | 84/421 |

* cited by examiner

*Primary Examiner* — Robert J Sandy
*Assistant Examiner* — Matthew Sullivan
(74) *Attorney, Agent, or Firm* — Novak Druce Connolly Bove + Quigg LLP

(57) ABSTRACT

A fastening device includes a first clamping arm, a second clamping arm pivotably connected to the first clamping arm and a mounting plate. The first clamping arm includes a first engaging portion. The first engaging portion defines a first threaded latching cutout. The second clamping arm includes a second engaging portion. The second engaging portion defines a second threaded latching cutout. The mounting plate attract the first engaging portion and the second engaging portion together. The first and second clamping arms are capable of being pivoted to make the first and second engaging portions abut against each other or moving away from each other. When the first and second engaging portions abut against each other, the first and second latching cutouts align with each other, to form a clamping hole to hold a threaded member.

11 Claims, 3 Drawing Sheets

FASTENING DEVICE

BACKGROUND

1. Technical Field

The disclosure relates to a fastening device.

2. Description of Related Art

Wrenches are used to assemble or disassemble nuts to or from threaded bolts and screws. However, different types of nuts need different types of wrenches, or the wrenches need to be adjusted according to the different types of nuts, which is inconvenient and time-consuming.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
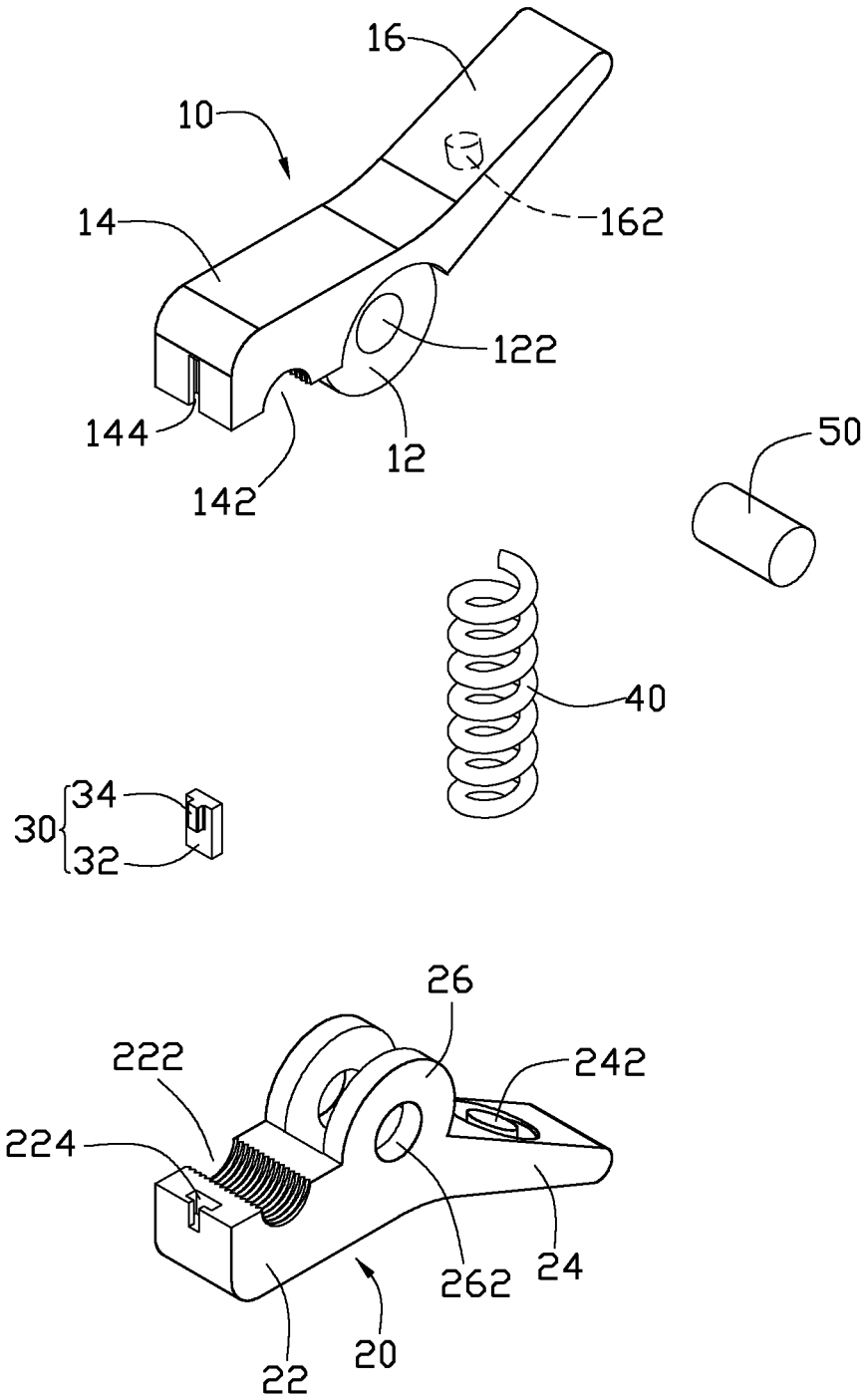
FIG. 1 is an exploded, isometric view of an exemplary embodiment of a fastening device.

Referring to FIG. 1, an exemplary embodiment of a fastening device includes a first clamping arm 10, a second clamping arm 20, a mounting plate 30, an elastic member 40 and a shaft 50. In this embodiment, the elastic member 40 is a helical spring.

The first clamping arm 10 includes a first engaging portion 14, a first operation portion 16 slantingly extending from a first end of the first engaging portion 14, and a pivot portion 12 extending down from a conjunction of the first engaging portion 14 and the first operation portion 16. The pivot portion 12 defines a pivot hole 122, with an axis of the pivot hole 122 substantially perpendicular to a longitudinal direction of the engaging portion 14. The first engaging portion 14 defines a first semi-cylindrical threaded latching cutout 142 in a bottom of the first engaging portion 14. A sidewall of a second end of the first engaging portion 14 away from the pivot portion 12 defines a first slide slot 144. A cross-section of the first slide slot 144 is substantially T-shaped. A first pin 162 extends from a bottom of the first operation portion 16.

The second clamping portion 20 includes a second engaging portion 22, a second operation portion 24 slantingly extending from a first end of the second engaging portion 22, and two spaced pivot pieces 26 extending from a conjunction between the second engaging portion 22 and the second operation portion 24. The pivot pieces 26 are substantially round, each defining a pivot hole 262 aligning with each other. The second engaging portion 22 defines a substantially semi-cylindrical second threaded latching cutout 222 t in a top of the second engaging portion 22. A sidewall of a second end of the second engaging portion 22 away from the pivot pieces 26 defines a second slide slot 224. A cross-section of the second slide slot 224 is substantially T-shaped. A second pin 242 extends from the second operation portion 24 toward the first operation portion 16 of the first clamping arm 10.

The mounting plate 30 is made of magnetic material, such as a magnet. The mounting plate 30 includes a main body 32 and an operation block 34 extending from a side of the main body 32. In this embodiment, the first clamping arm 10 and the second clamping arm 20 are made of iron, for attracting the mounting plate 30.

Figure 2:
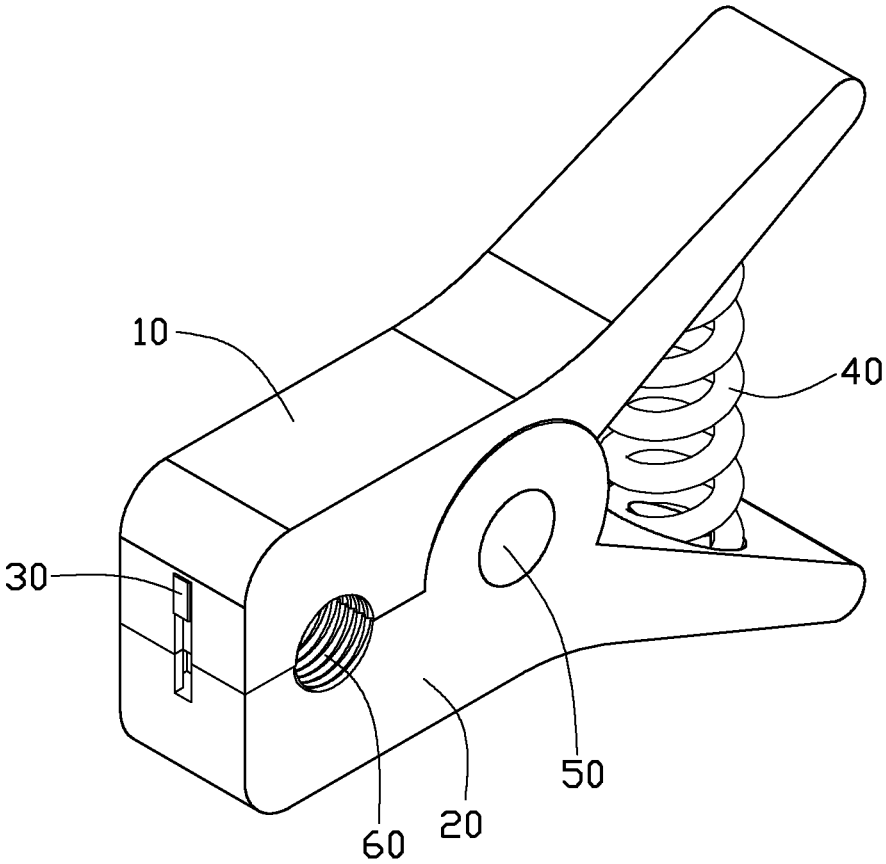
FIG. 2 is an assembled, isometric view of FIG. 1.
Figure 3:
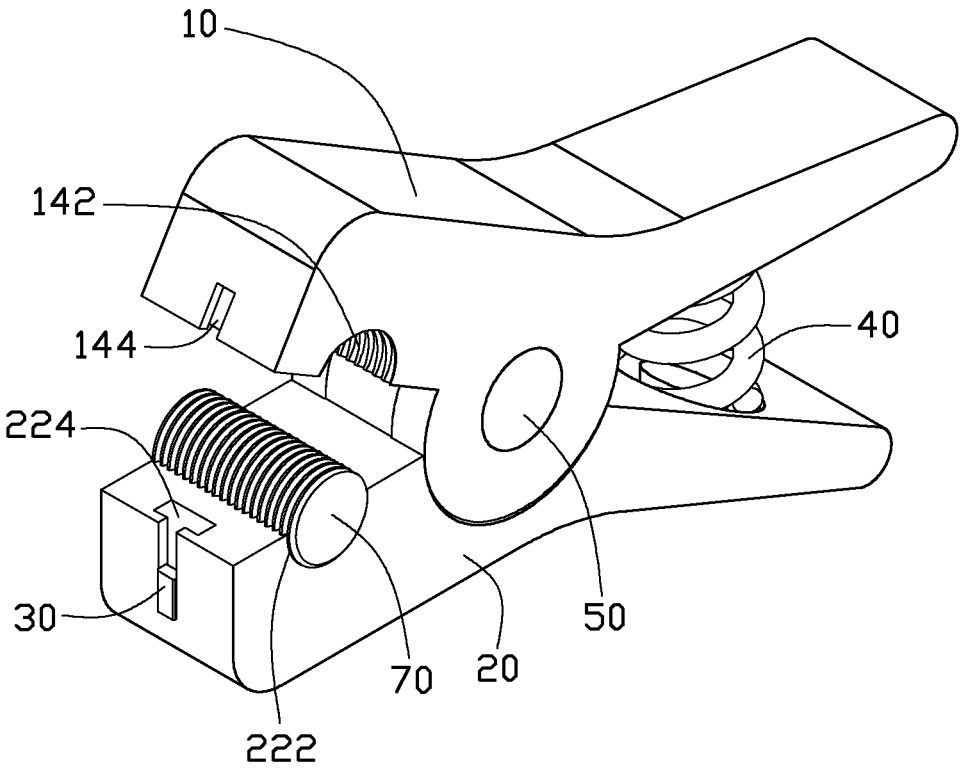
FIG. 3 shows a state of use of the fastening device of FIG. 2.

Referring to FIGS. 2 and 3, in assembly, the main body 32 of the mounting plate 30 is slidably received in the second slide slot 224 of the second engaging portion 22, and the operation block 34 extend through the second slide slot 224 to be exposed out of the second engaging portion 22. The pivot portion 12 of the first clamping arm 10 is placed between the pivot pieces 26. The pivot hole 122 of the pivot portion 12 is aligned with the pivot holes 262 of the pivot pieces 26. The shaft 50 pivotably extends through one of the pivot holes 262, the pivot hole 122, and the other pivot hole 262, to pivotably mount the first clamping arm 10 to the second clamping arm 20. The first engaging portion 14 abuts against the second engaging portion 22. The first slide slot 144 of the first clamping arm 10 and the second slide slot 224 of the second clamping arm 20 align and communicate with each other (shown in FIG. 2). The first threaded latching cutout 142 aligns with the second threaded latching cutout 222 to form a cylinder-shaped latching hole 60. The elastic member 40 is compressed to be deformed, and is fitted about the first and second pins 162 and 242 of opposite ends of the elastic member 40. Thereby the elastic member 40 is mounted between the first clamping arm 10 and the second clamping arm 20, to bias the first operation portion 16 to move away from the second operation portion 24.

In use, the first operation portion 16 and the second operation portion 24 are pressed toward each other to rotate the pivot portion 12 and the pivot pieces 26 about the shaft 50. The elastic member 40 is deformed and the first engaging portion 14 and the second engaging portion 22 are separated from each other. A threaded member 70, such as a screw, is partially received in the second thread latching cutout 222. The first operation portion 16 and the second operation portion 24 are released. The elastic member 40 is restored to rotate the pivot portion 12 and the pivot pieces 26 back about the shaft 50. The first engaging portion 14 and the second engaging portion 22 move toward each other to form the latching hole 60. The threaded member 70 is latched in the latching hole 60. The threads of the latching hole 60 engage with the threads of the threaded member 70 to tightly mount the fastening device and the threaded member 70 together. The mounting plate 30 is slid to position between the first slide slot 144 and the second slide slot 224 by operating the operation block 34. The first engaging portion 14, the second engaging portion 22, and the threaded member 70 are connected together by the mounting plate 30.

In disassembly, the mounting plate 30 is slid to move out of the first slide slot 144. The first operation portion 16 and the second operation portion 24 are pressed toward each other to pivot the pivot potion 12 and the pivot pieces 26 about the shaft 50. The elastic member 40 is deformed, and the first engaging portion 14 and the second engaging portion 22 are separated from each other. The threaded member 70 can be easily taken out from the fastening device.

It is believed that the present embodiment and its advantages will be understood from the foregoing description, and it will be apparent that various changes may be made thereto without departing from the spirit and scope of the description or sacrificing all of their material advantages, the example hereinbefore described merely being exemplary embodiment.

What is claimed is:

1. A fastening device comprising:

a first clamping arm comprising a first engaging portion, wherein the first engaging portion defines a first threaded latching cutout;

a second clamping arm pivotably connected to the first clamping arm and comprising a second engaging portion, wherein the second engaging portion defines a second threaded latching cutout; and a mounting plate to connect the first engaging portion and the second engaging portion together;

wherein the first and second clamping arms are capable of being pivoted to make the first and second engaging portions abut against each other or moving away from each other, when the first and second engaging portions abut against each other, the first and second latching cutouts align with each other, to form a clamping hole to hold a threaded member; and wherein a sidewall of the first engaging portion defines a first slide slot, a sidewall of the second engaging portion defines a second slide slot, the second slide slot aligns and communicates with the first slide slot in response to the first and second engaging portions abutting against each other, the mounting plate is slidably received in the first or second slide slot, and is capable of being positioned between the first and second slide slots to connect the first and second engaging portions together.

2. The fastening device of claim 1, further comprising an elastic member, wherein the first clamping arm further comprises a first operation portion slantingly extending from a first end of the first engaging portion, the second clamping arm further comprises a second operation portion slantingly extending from a first end of the second engaging portion, a first pin extends from the first operation portion toward the second operation portion, a second pin extends from the second operation portion toward the first operation portion, opposite ends of the elastic member are fitted about the first and second pins, to bias the first and second operation portions to move away from each other.

3. The fastening device of claim 2, wherein the second clamping arm further comprises two spaced pivot pieces extending from a conjunction between the second engaging portion and the second operation portion, the first clamping arm further comprises a pivot portion located between the pivot pieces and extending down from a conjunction of the first engaging portion and the first operation portion, the pivot pieces each define a first pivot hole aligning with each other, the pivot portion defines a second pivot hole aligning with the first pivot holes of the pivot pieces, a shaft pivotably extends through one of the first pivot holes, the second pivot hole, and the other first pivot hole.

4. The fastening device of claim 3, wherein the first slide slot is defined in a sidewall of a second end of the first engaging portion away from the pivot portion, the second slide slot is defined in a sidewall of a second end of the second engaging portion away from the pivot pieces.

5. The fastening device of claim 1, wherein sections of the first and second slide slots are substantially T-shaped, the mounting plate comprises a substantially rectangular main body and an operation block extending from the main body, the main body is slidably received in the first or second slide slot, and is capable of moving to be positioned between the first and second slide slots, the operation block extends through the first and second slots to be exposed out of the first and second slide slots.

6. The fastening device of claim 5, wherein the mounting plate is made of magnetic material, the first clamping arm and the second clamping arm are made of iron.

7. A fastening device comprising:

a first clamping arm comprising a first engaging portion, wherein the first engaging portion defines a first threaded latching cutout;

a second clamping arm pivotably connected to the first clamping arm and comprising a second engaging portion, wherein the second engaging portion defines a second threaded latching cutout; and a mounting plate to connect the first engaging portion and the second engaging portion together, wherein the mounting plate is made of magnetic material, the first clamping arm and the second clamping arm are made of iron; and wherein the first and second clamping arms are capable of being pivoted to make the first and second engaging portions abut against each other or moving away from each other, when the first and second engaging portions abut against each other, the first and second latching cutouts align with each other, to form a clamping hole to hold a threaded member.

8. The fastening device of claim 7, further comprising an elastic member, wherein the first clamping arm further comprises a first operation portion slantingly extending from a first end of the first engaging portion, the second clamping arm further comprises a second operation portion slantingly extending from a first end of the second engaging portion, a first pin extends from the first operation portion toward the second operation portion, a second pin extends from the second operation portion toward the first operation portion, opposite ends of the elastic member are fitted about the first and second pins, to bias the first and second operation portions to move away from each other.

9. The fastening device of claim 8, wherein the second clamping arm further comprises two spaced pivot pieces extending from a conjunction between the second engaging portion and the second operation portion, the first clamping arm further comprises a pivot portion located between the pivot pieces and extending down from a conjunction of the first engaging portion and the first operation portion, the pivot pieces each define a first pivot hole aligning with each other, the pivot portion defines a second pivot hole aligning with the first pivot holes of the pivot pieces, a shaft pivotably extends through one of the first pivot holes, the second pivot hole, and the other first pivot hole.

10. The fastening device of claim 9, wherein a sidewall of a second end of the first engaging portion away from the pivot portion defines a first slide slot, a sidewall of a second end of the second engaging portion away from the pivot pieces defines a second slide slot, the second slide slot aligns and communicates with the first slide slot in response to the first and second engaging portions abutting against each other, the mounting plate is slidably received in the first or second slide slot, and is capable of being positioned between the first and second slide slots to connect the first and second engaging portions together.

11. The fastening device of claim 10, wherein sections of the first and second slide slots are substantially T-shaped, the mounting plate comprises a substantially rectangular main body and an operation block extending from the main body, the main body is slidably received in the first or second slide slot, and is capable of moving to be positioned between the first and second slide slots, the operation block extends through the first and second slots to be exposed out of the first and second slide slots.

* * * * *